US011517101B2

(12) United States Patent
Key

(10) Patent No.: US 11,517,101 B2
(45) Date of Patent: Dec. 6, 2022

(54) ADAPTIVE ASSISTED GRIP APPARATUS

(71) Applicant: Dropsy Redhead Designs, LLC., Dacula, GA (US)

(72) Inventor: Jenna Key, Dacula, GA (US)

(73) Assignee: Dropsy Redhead Designs, LLC, Dacula, GA (US)

( * ) Notice: Subject to any disclaimer, the term of this patent is extended or adjusted under 35 U.S.C. 154(b) by 278 days.

(21) Appl. No.: 16/744,216

(22) Filed: Jan. 16, 2020

(65) Prior Publication Data

US 2021/0169204 A1 Jun. 10, 2021

Related U.S. Application Data

(60) Provisional application No. 62/943,747, filed on Dec. 4, 2019.

(51) Int. Cl.

| | |
|---|---|
| ***A45F 5/00*** | (2006.01) |
| ***A44C 5/00*** | (2006.01) |
| ***A47G 21/02*** | (2006.01) |
| ***B26B 3/02*** | (2006.01) |
| ***A47G 21/04*** | (2006.01) |

(52) U.S. Cl.

CPC ..... *A45F 5/00* (2013.01); *A44C 5/0007* (2013.01); *A45F 2005/008* (2013.01); *A47G 21/023* (2013.01); *A47G 21/04* (2013.01); *B26B 3/02* (2013.01)

(58) Field of Classification Search

CPC ..... A45F 2005/008; A45F 2005/006; A45F 2200/05; A45F 2200/0566; A45F 5/00; B63K 23/001; B63K 43/001; A44C 5/0046

USPC .... 401/8, 131; 224/251, 219–221, 257, 258; D3/229

See application file for complete search history.

(56) References Cited

U.S. PATENT DOCUMENTS

| | | | | | |
|---|---|---|---|---|---|
| 831,391 | A | * | 9/1906 | Ubellar | A47F 5/0006 279/158 |
| 1,455,879 | A | * | 5/1923 | Gronlund | B43K 23/001 24/3.13 |
| D129,716 | S | * | 9/1941 | Trollen | D3/300 |
| 4,023,712 | A | * | 5/1977 | Babiak | A44C 25/002 D11/7 |
| D277,559 | S | * | 2/1985 | Mackie | D11/6 |
| 4,674,298 | A | * | 6/1987 | Wimmershoff-Caplan | B43K 25/00 224/616 |
| 4,884,730 | A | * | 12/1989 | Carpenter | A45B 1/04 224/901.4 |
| D310,101 | S | * | 8/1990 | Gauthier | D19/204 |
| D316,184 | S | * | 4/1991 | Mikkelsen | D11/7 |

(Continued)

*Primary Examiner* — Justin M Larson

(74) *Attorney, Agent, or Firm* — aylor English Duma LLP

(57) ABSTRACT

Implementations of an adaptive assisted grip apparatus are provided. In some implementations, the adaptive assisted grip apparatus comprises a holder and a wrist strap.

In some implementations, a method of using the adaptive assisted grip apparatus comprises inserting a makeup applicator or other suitable item into the holder, placing the wrist strap around a user's wrist, grasping and holding the makeup applicator or other suitable item using the holder, and using the wrist strap to prevent the makeup applicator or other suitable item inserted in the holder from falling to the floor/ground or otherwise being dropped if/when the user loses grip of the holder.

21 Claims, 5 Drawing Sheets

(56) References Cited

U.S. PATENT DOCUMENTS

D338,037 S * 8/1993 Miller ..... 401/131
5,379,928 A * 1/1995 Mikkelsen ..... A45C 13/30 224/614
D381,805 S * 8/1997 Case ..... D3/229
5,664,712 A * 9/1997 Smrt ..... A45F 5/02 224/904
5,718,023 A * 2/1998 Billish ..... A45F 5/02 24/336
D404,562 S * 1/1999 Brown ..... D3/229
D417,778 S * 12/1999 Karlin, III ..... D3/229
D434,896 S * 12/2000 Haugh ..... D9/434
6,196,382 B1 * 3/2001 Lenderman ..... F23Q 2/34 206/37
6,234,307 B1 * 5/2001 Beck ..... A63B 55/20 206/315.9
6,382,481 B1 * 5/2002 McIlmoil ..... A45F 5/004 224/245
6,394,677 B2 * 5/2002 Wang ..... B43K 23/02 401/202
D464,793 S * 10/2002 Anderton ..... D3/215
6,499,899 B2 * 12/2002 Sawyer ..... B43K 23/002 401/48
D468,092 S * 1/2003 Anderton ..... D3/215
D475,088 S * 5/2003 Cetera ..... D19/195
6,685,068 B1 * 2/2004 Thompson ..... A45F 5/00 224/269
6,776,318 B2 * 8/2004 Washington ..... A45F 5/021 224/676
D495,875 S * 9/2004 Spence, Jr. ..... D7/624.2
6,814,237 B2 * 11/2004 Gorvett ..... A45D 40/24 206/823
6,830,402 B2 * 12/2004 Sunatori ..... B43K 25/00 401/131
6,854,681 B2 * 2/2005 Kish ..... A45F 5/004 242/380
D502,311 S * 3/2005 Ellis ..... D3/215
D526,775 S * 8/2006 Anderton ..... D3/215
D528,290 S * 9/2006 Anderton ..... D3/215
7,195,413 B2 * 3/2007 Kremizis ..... A45F 5/004 224/677
7,252,450 B2 * 8/2007 Aguirre ..... A44C 5/0046 224/267
7,270,289 B2 * 9/2007 Kish ..... A45F 5/004 242/280
D563,096 S * 3/2008 Ivey ..... D3/205
D605,400 S * 12/2009 Matt ..... D3/229
D625,513 S * 10/2010 Carnes ..... D7/624.2
D713,712 S * 9/2014 Beversluis ..... D8/396
8,833,717 B1 * 9/2014 Holmes ..... F16M 13/00 211/113
9,182,072 B1 * 11/2015 Holmes ..... A47L 13/512
D764,787 S * 8/2016 Montminy ..... D3/202
D801,579 S * 10/2017 Nyaggah ..... D27/183
10,086,640 B2 * 10/2018 Kish ..... B25B 29/00
D852,422 S * 6/2019 Wei ..... D28/76
D863,754 S * 10/2019 Baker, IV ..... D3/215
10,925,383 B2 * 2/2021 Murakami ..... A45D 40/00
2002/0179655 A1 * 12/2002 Finlay ..... A45F 5/00 224/251
2004/0026556 A1 * 2/2004 Kish ..... A45F 5/004 242/380
2004/0031829 A1 * 2/2004 Guimond ..... A45F 5/00 224/604
2005/0199512 A1 * 9/2005 Davidson ..... A45F 5/02 206/37
2005/0220529 A1 * 10/2005 Katsanevas ..... A45F 5/00 401/131
2006/0039740 A1 * 2/2006 Mackay ..... A45F 5/02 401/131
2007/0119884 A1 * 5/2007 Moreau ..... B43K 23/001 224/669
2007/0278267 A1 * 12/2007 Stierstorfer ..... A45D 29/12 224/217
2007/0286667 A1 * 12/2007 Katsanevas ..... A45F 5/00 401/8
2008/0054033 A1 * 3/2008 Synness ..... A45F 5/02 224/181
2009/0202287 A1 * 8/2009 Katsanevas ..... A45F 5/00 401/131
2010/0122709 A1 * 5/2010 Janatpour ..... A45F 5/00 132/286
2011/0008093 A1 * 1/2011 Treacy ..... B65H 75/48 401/131
2014/0068922 A1 * 3/2014 Roffe ..... B44D 3/123 29/525.08
2014/0130543 A1 * 5/2014 Demmer ..... A44C 25/002 29/896.41
2015/0183262 A1 * 7/2015 Collins, III ..... B43L 23/08 30/451
2015/0201742 A1 * 7/2015 Tomko ..... A45C 13/28 224/219
2016/0021991 A1 * 1/2016 Franco ..... A44C 5/003 63/1.14
2017/0096027 A1 * 4/2017 Kish ..... B25B 29/00
2018/0168323 A1 * 6/2018 Page ..... A45F 5/022
2021/0112956 A1 * 4/2021 Miller ..... B43K 23/001
2021/0169204 A1 * 6/2021 Key ..... A44C 5/003
2021/0368958 A1 * 12/2021 Moore ..... A45D 26/0042

* cited by examiner

ADAPTIVE ASSISTED GRIP APPARATUS

CROSS REFERENCE TO RELATED APPLICATION

This application claims the benefit of U.S. Patent Application Ser. No. 62/943,747, which was filed on Dec. 4, 2019, and is incorporated herein by reference in its entirety.

TECHNICAL FIELD

This disclosure relates to implementations of an adaptive assisted grip apparatus.

BACKGROUND

For those suffering with arthritis and other ailments that affects fine motor coordination, putting on make-up can be problematic. For example, putting on mascara and lipstick can be difficult because it can be difficult to grab and hold on to the applicator tube. Persons with fine motor skill problems drop items frequently. However, there does not exist an apparatus configured to help a person with grabbing make-up applicators or other items and holding on to and preventing such items from falling to the floor or otherwise being dropped.

DETAILED DESCRIPTION

Implementations of an adaptive assisted grip apparatus are provided. In some implementations, the adaptive assisted grip apparatus comprises a holder and a wrist strap.

In some implementations, the adaptive assisted grip apparatus is configured to help a user to grab a make-up applicator or other suitable item. In some implementations, the adaptive assisted grip apparatus is configured to help the user to hold on to and/or prevent such item from falling to the floor/ground or otherwise being dropped.

In some implementations, a method for using the adaptive assisted grip apparatus comprises inserting a makeup applicator or other suitable item into the holder, placing the wrist strap around a user's wrist, grasping and holding the makeup applicator or other suitable item using the holder, and using the wrist strap to prevent the makeup applicator or other suitable item inserted in the holder from falling to the floor/ground or otherwise being dropped if/when the user loses grip of the holder.

Figure 2:
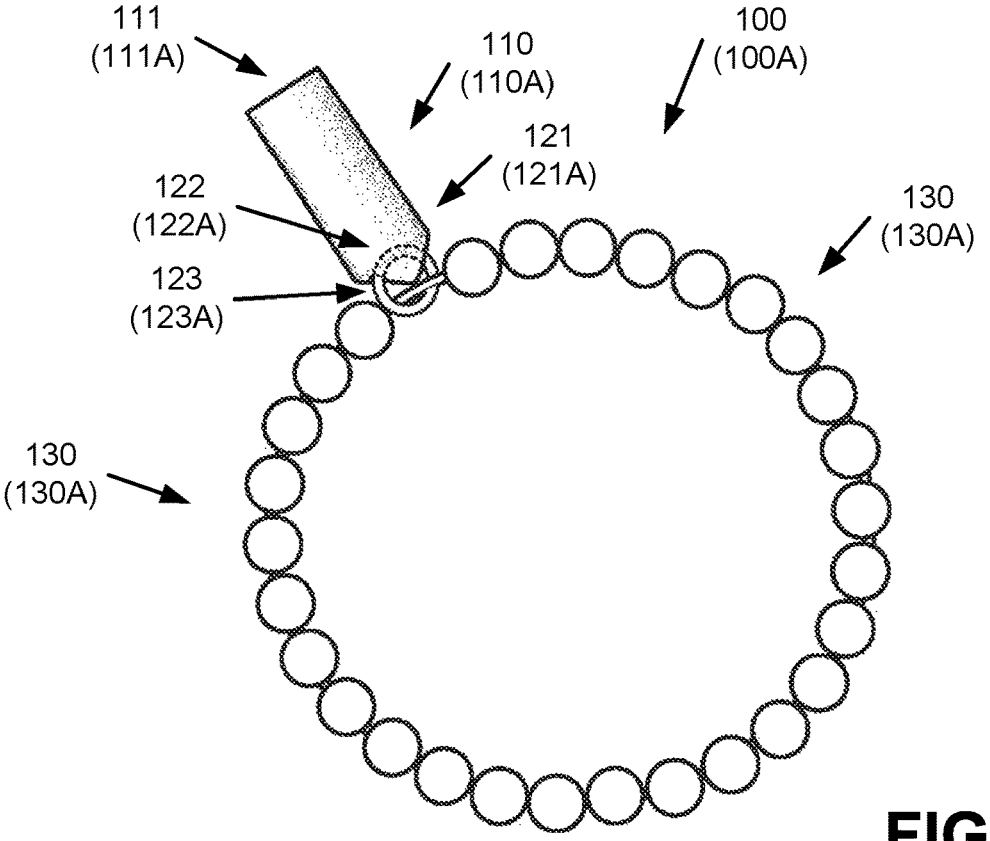
FIGS. 2-9 illustrate implementations of an example adaptive assisted grip apparatus according to the present disclosure.

FIGS. 2-9 illustrate implementations of an example adaptive assisted grip apparatus 100 according to the present disclosure. As shown in FIG. 2, in some implementations, the adaptive assisted grip apparatus 100 (100A) comprises a holder 110 (110A) and a wrist strap 130 (130A).

Figure 6:
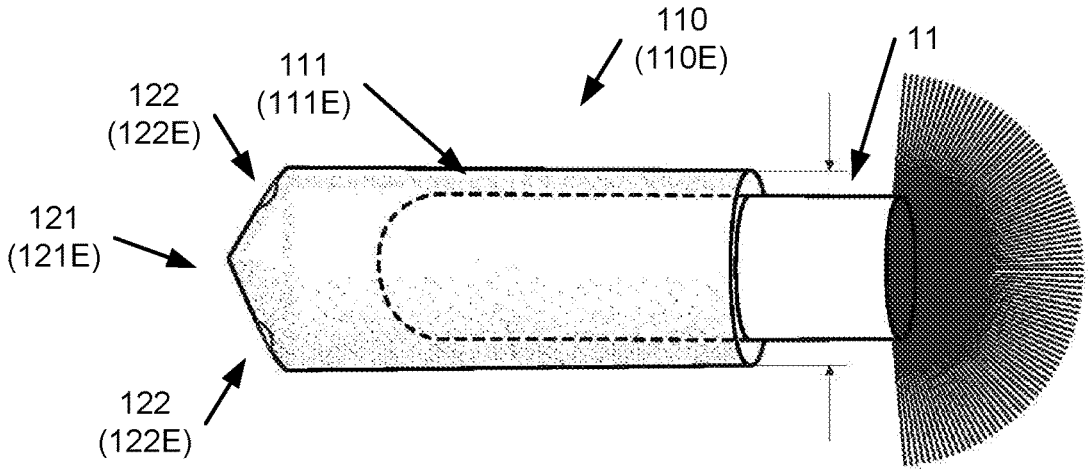
Figure 7:
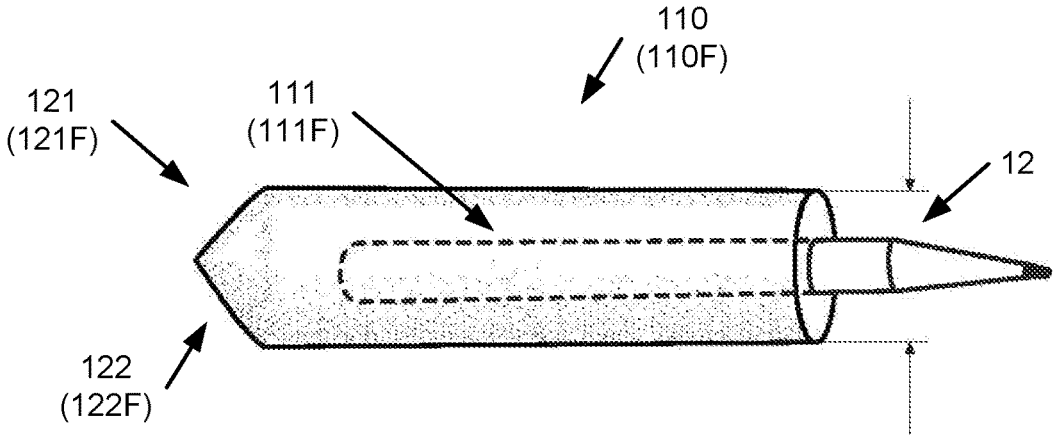

As shown in FIGS. 6 and 7, in some implementations, the holder 110 comprises an opening 111 (111E, 111F). As shown in FIGS. 2, 6, 8, and 9, in some implementations, the holder 110 (110A, 110E, 110G, 110H) comprises an attachment portion 121 (121A, 121E, 121G, 121H).

Figure 9:
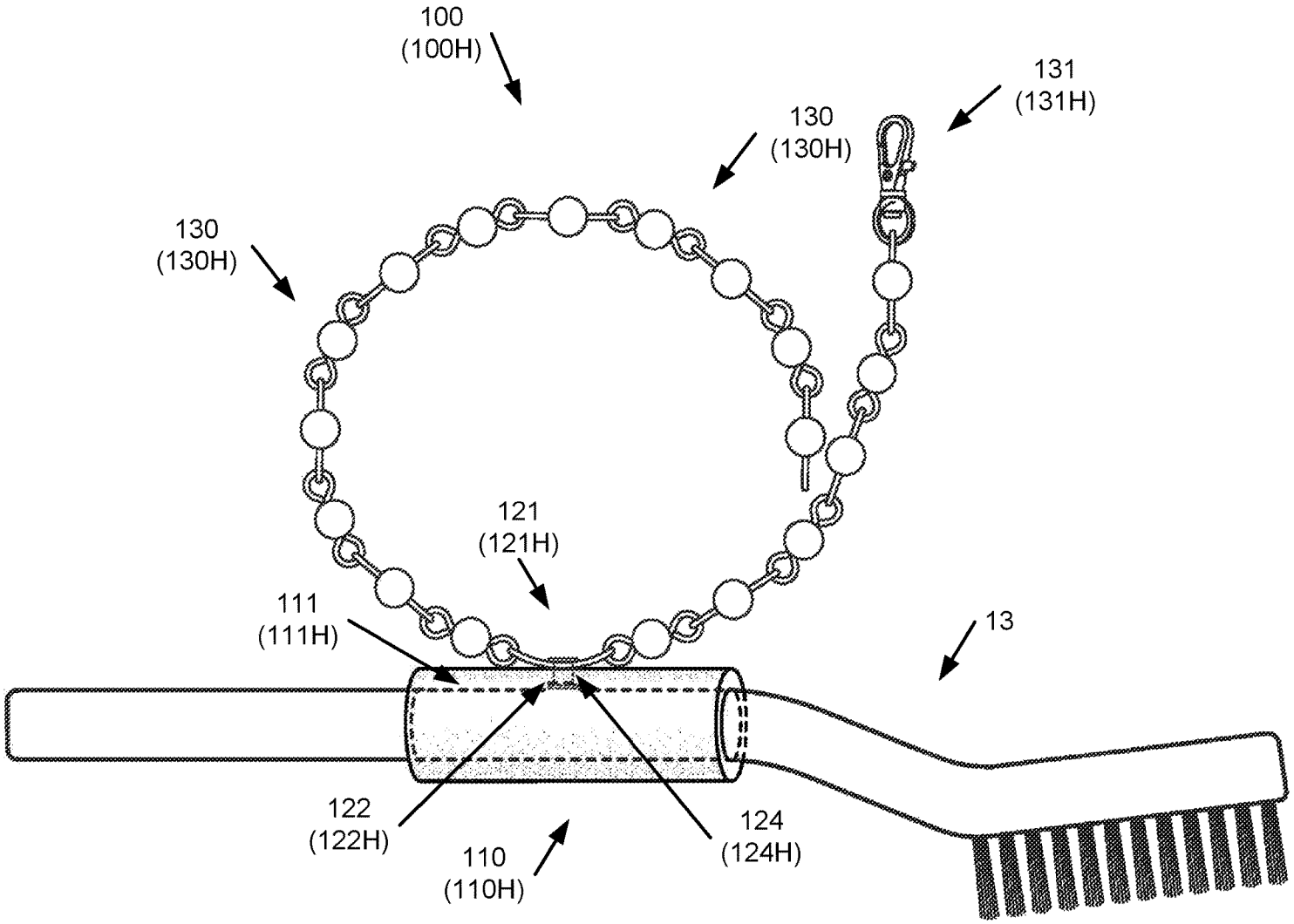

As shown in FIGS. 6 and 7, in some implementations, the opening 111 extends through at least a portion of the holder 110. As shown in FIG. 9, in some implementations, the opening 111 (111H) may fully extend through the holder 110. In some implementations, the opening 111 may extend through the holder 110 in any other suitable configuration.

In some implementations, the holder opening 111 extends parallel or generally parallel to the length (e.g., along the longest dimension) of the holder 110. In some implementations, the opening 111 may extend in any other suitable configuration with respect to the holder 110.

As shown in FIGS. 6, 7 and 9, in some implementations, the holder opening 111 is configured to receive at least a portion of a makeup applicator 11, 12, 13. For example, in some implementations, the opening 111 may be configured to receive an end portion of a makeup applicator 11, 12, 13. In some implementations, the opening 111 may be configured to receive any other suitable portion of a makeup applicator 11, 12, 13.

As shown in FIG. 6, in some implementations, the makeup applicator 11 may be a lipstick tube. As shown in FIG. 7, in some implementations, the makeup applicator 12 may be a makeup pencil, such as for eyeliner, mascara, lipstick, etc. As shown in FIG. 9, in some implementations, the makeup applicator 13 may be a makeup brush, such as for mascara. In some implementations, the makeup applicator may be any other suitable type of makeup applicator.

In some implementations, the holder opening 111 may be configured to receive at least a portion of any other suitable item. For example, in some implementations, the opening 111 may be configured receive at least a portion of a utensil, such as a spoon, fork, or knife.

Figure 8:
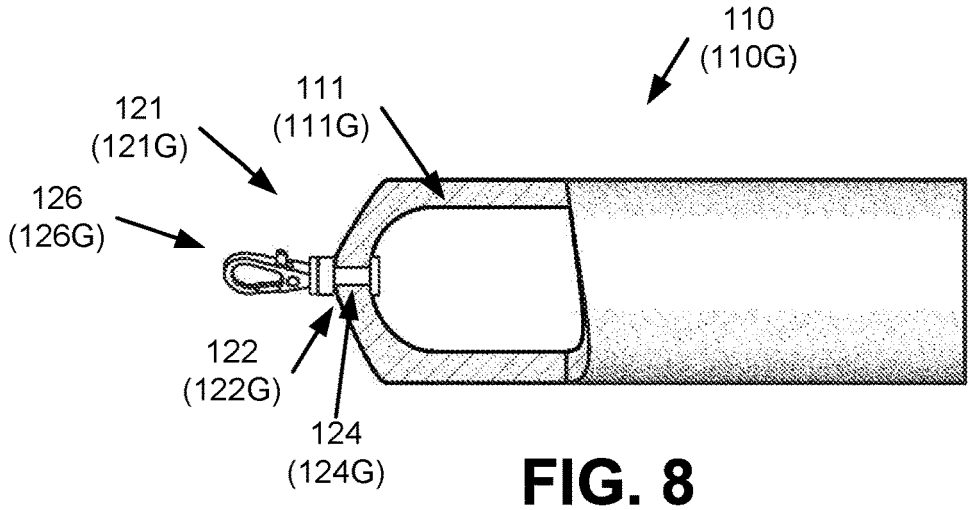

As shown in FIG. 6, in some implementations, the holder attachment portion 121 comprises an opening 122 (122E). As shown in FIG. 2, in some implementations, the attachment portion 121 may further comprise a ring 123 (123A) or similar connecting component. As shown in FIGS. 8 and 9, in some implementations, the attachment portion 121 may further comprise a pin 124 (124G, 124H) or similar connecting component. As shown in FIG. 8, in some implementations, the attachment portion 121 may further comprise a snap hook 126 (126G) or similar connecting component.

As shown in FIGS. 2 and 6, in some implementations, the attachment opening 122 fully extends through a portion of the holder 110. As shown in FIGS. 8 and 9, in some implementations, the opening 122 may extend through at least a portion of the holder 110. In some implementations, the opening 122 may extend through the holder 110 in any other suitable configuration.

As shown in FIGS. 2, 6, and 9, in some implementations, the attachment opening 122 extends perpendicular or generally perpendicular to the length of the holder 110 and/or to the holder opening 111. As shown in FIG. 8, in some implementations, the opening 122 may extends parallel or generally parallel to the length of the holder 110 and/or to the holder opening 111. In some implementations, the opening 111 may extend in any other suitable configuration with respect to the holder 110 and/or to the holder opening 111.

Figure 3:
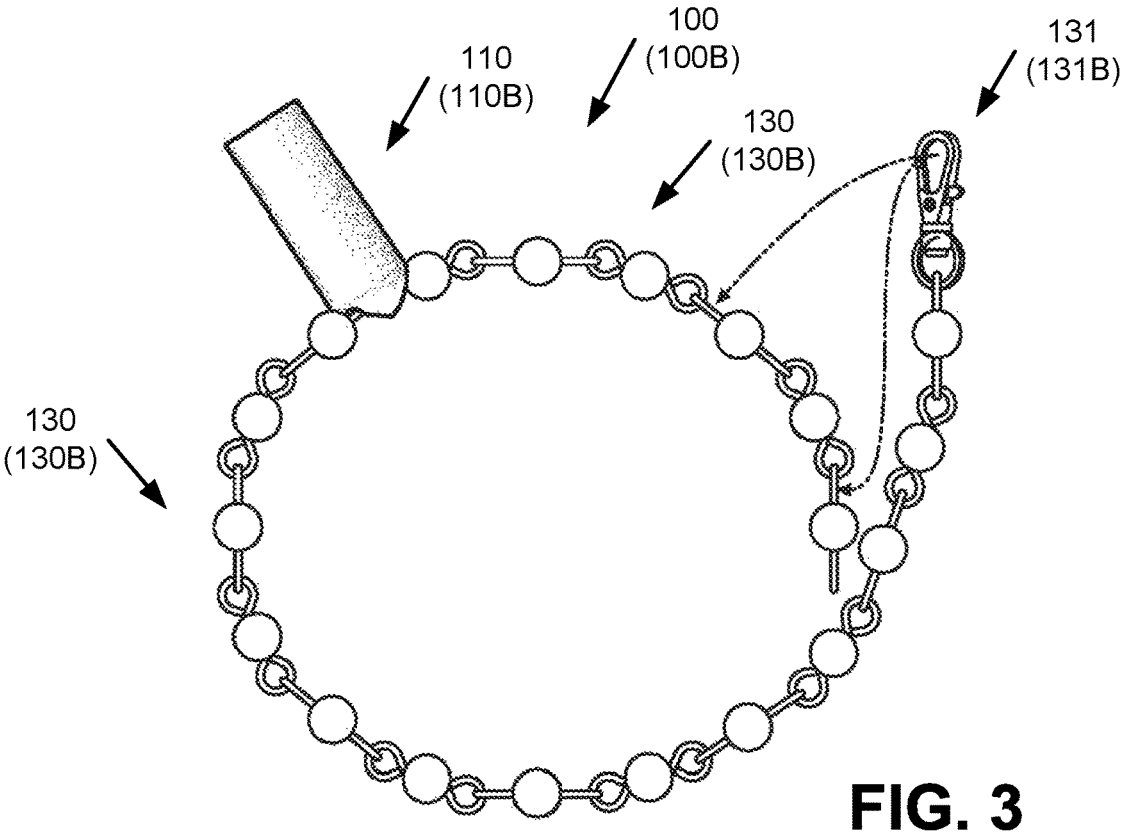
Figure 4:
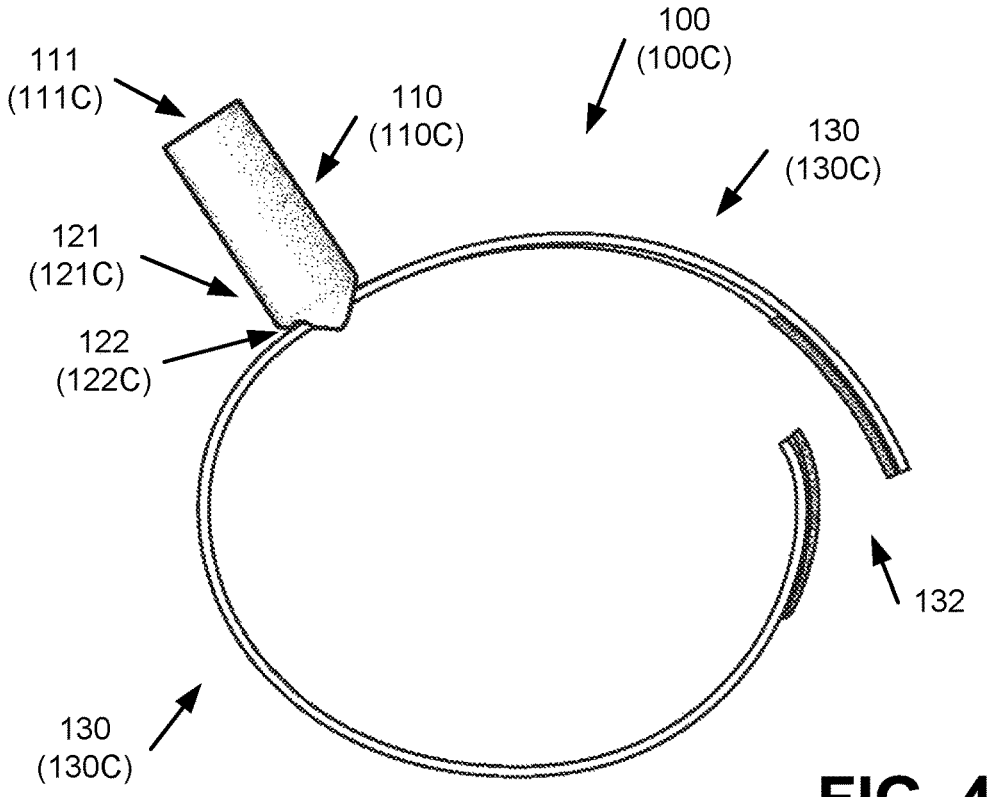
Figure 5:
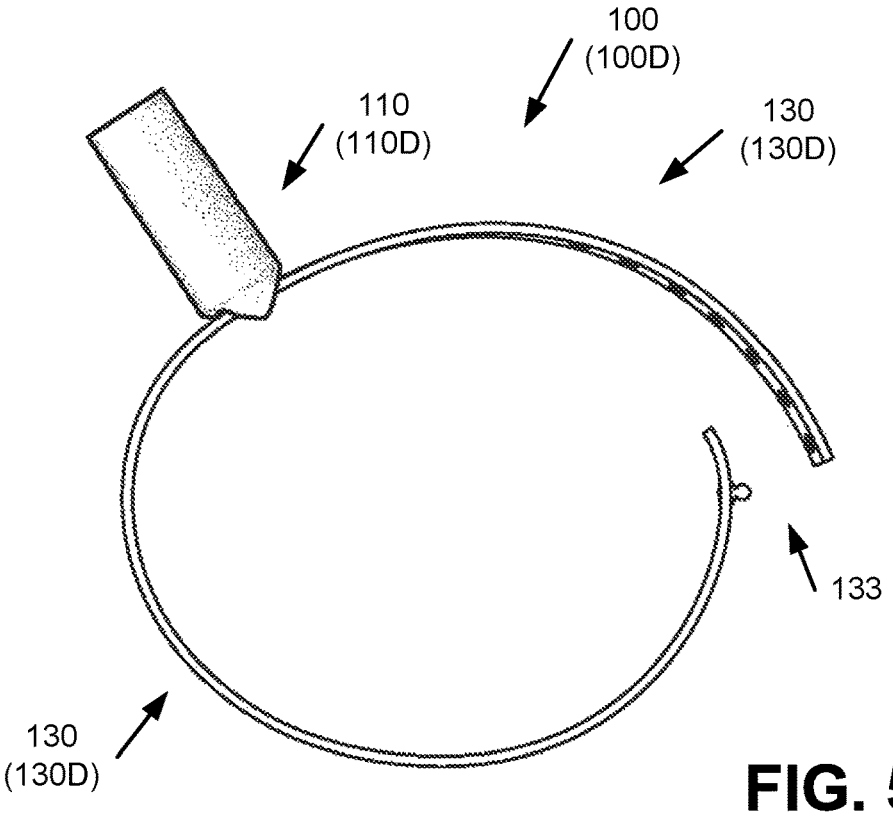

As shown in FIGS. 3-5, in some implementations, the attachment opening 122 (122B, 122C, 122D) is configured to receive the wrist strap 130 (130B, 130C, 130D) of the adaptive assisted grip apparatus 100 (100B, 100C, 100D) such that the wrist strap 130 extends through the holder opening 111 and is thereby connected to the holder 110. In some implementations, the strap 130 may be thereby moveably connected to the holder 110 such that the strap 130 can rotate or otherwise move through or about the opening 111. In some implementations, the strap 130 is thereby connected to the holder 110 such that the strap 130 can support the holder 110 to prevent the holder 110 from falling to the floor/ground or otherwise being dropped, such as while holding a makeup applicator or other suitable item in the holder opening 111.

As shown in FIG. 2, in some implementations, the ring 123 extends through the attachment opening 122 such that the ring 123 is connected to the holder 110. In some implementations, the ring 123 may be thereby moveably connected to the holder 110 such that the ring 123 can rotate or otherwise move through or about the opening 122.

As shown in FIG. 2, in some implementations, the ring 123 is configured to receive the wrist strap 130 such that the strap 130 extends through the ring 123 and is thereby connected to the ring 123 and coupled to the holder 110. In some implementations, the strap 130 may be thereby moveably connected to the ring 123 such that the strap 130 can rotate or otherwise move through or about the ring 123. In some implementations, the strap 130 is thereby coupled to the holder 110 such that the strap 130 can support the holder 110 to prevent the holder 110 from falling to the floor/ground or otherwise being dropped, such as while holding a makeup applicator or other suitable item in the holder opening 111.

As shown in FIGS. 8 and 9, in some implementations, the pin 124 extends through the attachment opening 122 such that the pin 124 is connected to the holder 110. In some implementations, the pin 124 may be thereby moveably connected to the holder 110 such that the pin 124 can rotate or otherwise move through or about the opening 122.

As shown in FIG. 9, in some implementations, the pin 124 is configured to receive and/or otherwise connect to the wrist strap 130 such that the strap 130 extends through the pin 124 and/or is otherwise connected to the pin 124 and thereby coupled to the holder 110. In some implementations, the strap 130 may be thereby moveably connected to the pin 124 such that the strap 130 can rotate or otherwise move through or about the pin 124. In some implementations, the strap 130 is thereby coupled to the holder 110 such that the strap 130 can support the holder 110 to prevent the holder 110 from falling to the floor/ground or otherwise being dropped, such as while holding a makeup applicator or other suitable item in the holder opening 111.

As shown in FIG. 8, in some implementations, the snap hook 126 is connected or otherwise attached to the pin 124. In some implementations, the snap hook 126 may be thereby moveably connected to the pin 124 and/or the holder 110 such that the snap hook 126 can rotate or otherwise move with respect to the pin 124 and/or the opening 122.

As shown in FIG. 8, in some implementations, the snap hook 126 is configured to receive the wrist strap 130 such that the strap 130 extends through the snap hook 126 and is thereby connected to the snap hook 126 and coupled to the holder 110. In some implementations, the strap 130 may be thereby moveably connected to the snap hook 126 such that the strap 130 can rotate or otherwise move through or about the snap hook 126. In some implementations, the strap 130 is thereby coupled to the holder 110 such that the strap 130 can support the holder 110 to prevent the holder 110 from falling to the floor/ground or otherwise being dropped, such as while holding a makeup applicator or other suitable item in the holder opening 111.

In some implementations, the snap hook 126 is configured to be removably connected to the wrist strap 130. For example, in some implementations, the snap hook 126 can be opened/closed to connect or remove the wrist strap 130.

Figure 1:
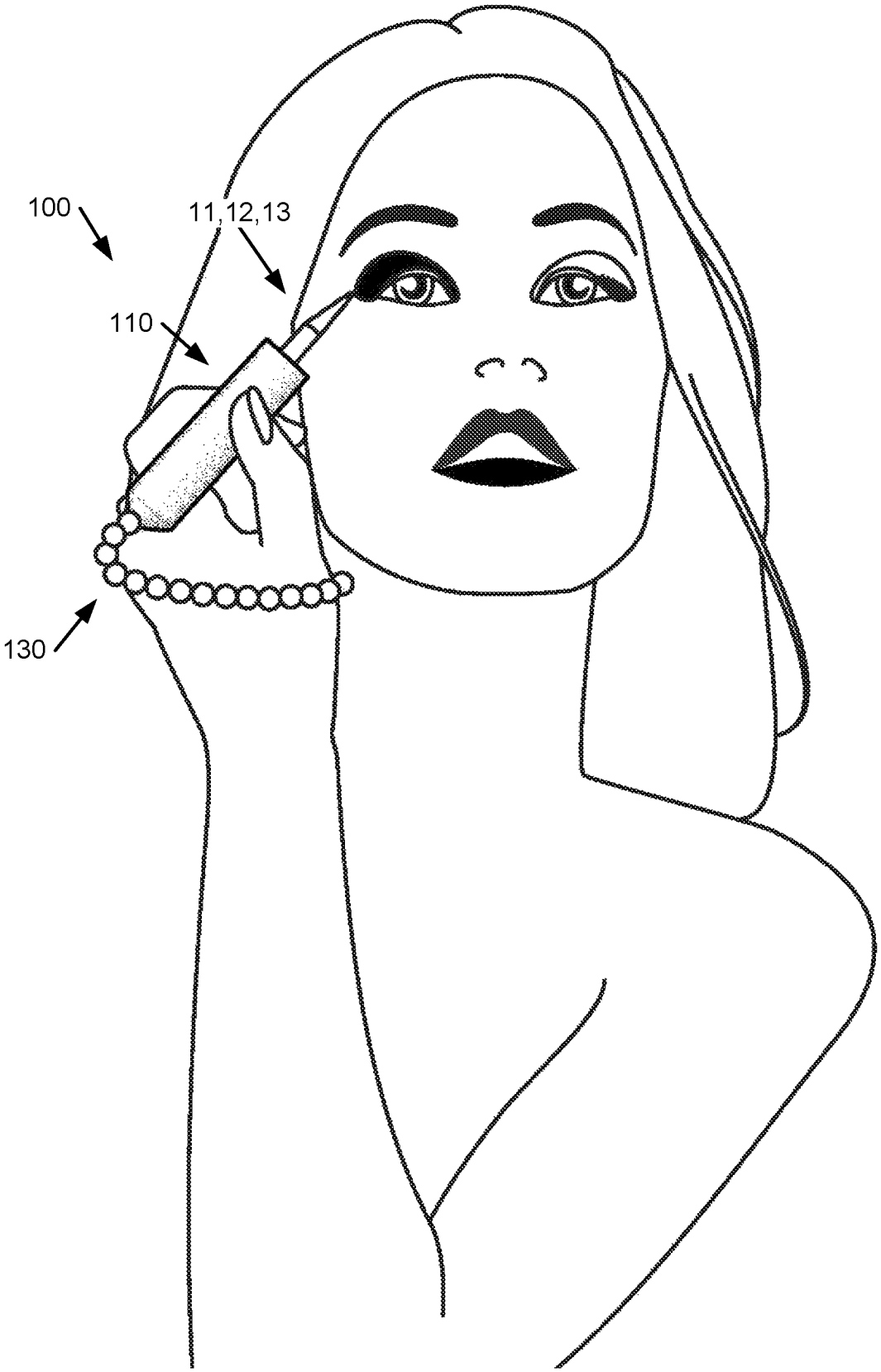
FIG. 1 illustrates an example use of an adaptive assisted grip apparatus according to the present disclosure.

FIG. 1 illustrates an example use of an adaptive assisted grip apparatus 100 according to the present disclosure. As shown in FIG. 1, in some implementations, the holder 110 is configured such that the width of the holder 110 is wide enough to aid a user in gripping a make-up applicator, such as a makeup applicator 11, 12, 13 described above. In some implementations, the holder 110 is configured such that any other suitable dimension of the holder 110 is sufficient to allow a user to grip or otherwise hold a make-up applicator.

In some implementations, the holder 110 is configured such that any suitable dimension of the holder 110, such as the width as described above, is sufficient to allow a user to grip or otherwise hold any other suitable item, such as a utensil as described above.

As shown in FIGS. 6, 7 and 9, in some implementations, the holder 110 is configured such that the holder opening 111 conforms to the shape of an inserted makeup applicator, such as a makeup applicator 11, 12, 13 described above. In some implementations, the holder 110 is so configured such that holder 110 clings to or otherwise engages the makeup applicator inserted into the opening 111 to hold or otherwise secure the applicator in the opening 111.

In some implementations, the holder 110 may be composed of a spongy, rubbery material that allows the holder 110 to conform to and hold a makeup applicator or other suitable item and to be held by a user as described above. In some implementations, the holder 110 may be composed of any other suitable material.

As shown in FIG. 2, in some implementations, the wrist strap 130 comprises a continuous or closed loop configuration of material. As shown in FIGS. 3-5 and 9, in some implementations, the wrist strap 130 comprises a separable or openable loop configuration of material. In some implementations, the wrist strap 130 may comprise any other suitable configuration of material.

In some implementations, the continuous loop wrist strap 130, such as shown in FIG. 2, is configured to be big enough to receive a user's hand therethrough and to encircle the user's wrist to allow the user to wear the wrist strap 130. For example, in some implementations, the continuous loop strap 130 may be configured to stretch. In some implementations, the continuous loop strap 130 may be configured to fit as described in other suitable way.

As shown in FIGS. 3 and 9, in some implementations, the separable loop wrist strap 130 may comprise a clasp (or snap hook) 131 or similar connecting component that is configured to allow the separable loop strap 130 to be opened and closed.

As shown in FIG. 4, in some implementations, the separable loop wrist strap 130 may comprise a hook and loop closure (e.g., Velcro®) 132 or similar connecting component that is configured to allow the separable loop strap 130 to be opened and closed.

As shown in FIG. 5, in some implementations, the separable loop wrist strap 130 may comprise a snap or button closure 133 or similar connecting component that is configured to allow the separable loop strap 130 to be opened and closed.

In this way, in some implementations, the separable loop strap 130 can be received over a user's hand and around the user's wrist to allow the user to wear the wrist strap 130 by opening and closing the above described connector 131, 132, 133.

In some implementations, the wrist strap 130 is configured to connect to and extend from the holder 110, such as described above with respect to the holder attachment portion 121.

In some implementations, the above described configurations of the separable loop strap 130 are configured to be adjustable in length to fit a user's wrist. For example, as shown in FIGS. 3 and 9, in some implementations, the separable loop strap 130 can be adjusted in length by connecting the clasp 130 to different positions on the strap 130 to vary the size of the loop.

Similarly, as shown in FIGS. 4 and 5, in some implementations, the separable loop strap 130 can be adjusted in length by connecting the closure 132, 133 at different positions on the strap 130 to vary the size of the loop. In some implementations, the separable loop strap 130 may be adjustable in length in any other suitable way to vary the size of the loop.

In some implementations, the wrist strap 130, such as the above described continuous and separable configurations, is configured to be worn on a user's wrist or similarly worn to prevent the holder 110 from falling to the floor/ground or otherwise being dropped, such as while holding a makeup applicator or other suitable item in the holder opening 111. For example, while wearing the wrist strap 130 and holding a makeup applicator or other suitable item by the holder 110, if a user loses grip of the holder 110, the wrist strap 130 prevents the applicator or other suitable item from falling to the ground, floor, other applicable surface.

In some implementations, the wrist strap 130, such as the above describe continuous loop configuration, may be composed of a material configured to stretch. In some implementations, the wrist strap 130, such as the above describe separable loop configuration, may be composed of a material configured not to or to minimally stretch. In some implementations, the wrist strap 130 may be composed of a material configured to have any other suitable features.

As shown in FIGS. 2, 3, and 9, in some implementations, the wrist strap 130 may be configured to have a decorative or otherwise appealing appearance. For example, in some implementations, the wrist strap 130 may comprise beads, pearls (e.g., imitation or simulated), or similar components. In some implementations, the wrist strap 130 may be configured to have any other suitable appearance.

In some implementations, the adaptive assisted grip apparatus 100 is configured to help a user to grab a make-up applicator or other suitable item. In some implementations, the adaptive assisted grip apparatus 100 is configured to help the user to hold on to and/or prevent such item from falling to the floor/ground or otherwise being dropped.

In some implementations, the adaptive assisted grip apparatus 100 comprises any suitable dimensions, such as the examples described above with respect to features of the adaptive assisted grip apparatus 100.

In some implementations, the adaptive assisted grip apparatus 100 is composed of any suitable materials, such as the above described examples.

In some implementations, the adaptive assisted grip apparatus 100 can have any suitable appearance, such as the above described examples.

In some implementations, an example method of using the adaptive assisted grip apparatus 100, with respect to the above-described FIGs., comprises inserting a makeup applicator, such as a makeup applicator 11, 12, 13, or other suitable item into the holder opening 111. In some implementations, an end portion of the makeup applicator is inserted in the opening 111 such that the makeup applicator can be used by holding the holder 110.

In some implementations, the method comprises placing the wrist strap 130 around a user's wrist. In some implementations, a continuous loop wrist strap 130 is stretched over the user's hand and released to encircle the user's wrist. In some implementations, a separable loop wrist strap 130 is opened and closed using the connector 131, 132, 133 to position the strap 130 around the user's wrist. In some implementations, the connector 131, 132, 133 is connected to different positions on the strap 130 to adjust the length of the strap 130 to fit around the user's wrist.

In some implementations, the method comprises grasping and holding the makeup applicator or other suitable item using the holder 110.

In some implementations, the method comprises using the wrist strap 130 positioned around the user's wrist to prevent the holder 110 and thereby the inserted makeup applicator or other suitable item from falling to the floor/ground or otherwise being dropped if/when the user loses grip of the holder 110.

The figures, including photographs and drawings, comprised herewith may represent one or more implementations of the adaptive assisted grip apparatus.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. An adaptive assisted grip apparatus for a cosmetics product, comprising a holder and a wrist strap, wherein:

the holder comprises an elongated piece of resilient, compressible material having an insertion opening and a wrist strap connection opening;

the insertion opening extends at least partially into the holder parallel to the length of the holder;

the insertion opening is configured to receive the cosmetics product inserted at least partially within the insertion opening, the insertion opening further configured to expand and contract to accommodate both the size and the shape of the inserted cosmetics product, and to thereby grip and retain the item cosmetics product within the insertion opening;

the wrist strap connection opening extends at least partially into the holder;

the wrist strap connection opening is configured to couple the wrist strap to the holder such that the wrist strap prevents the holder from falling to a ground or floor surface when the wrist strap is worn by the user and the user drops the holder from the user's hand;

the holder is configured to be held in the hand of a user and to hold the cosmetics product at least partially inserted into the insertion opening such that the cosmetics product can be held and used by the user by handling the holder;

the wrist strap comprises a loop of material coupled to the holder by the wrist strap opening and configured to be positioned around the user's wrist and worn by the user; and the wrist strap is configured to couple to the holder and prevent the holder from falling to the ground or floor surface when the wrist strap is worn by the user and the user drops the holder from the user's hand;

whereby the adaptive assisted grip apparatus is configured to allow the user to grab and hold the cosmetics product and to prevent the cosmetics product from falling to the ground or floor surface when the user drops the cosmetics product; and wherein:

the insertion opening is configurable in an undeformed configuration when the cosmetics product is not received in the insertion opening and a deformed configuration when the cosmetics product is received within the insertion opening;

the insertion opening defines a length; and a width of the insertion opening is consistent along the length thereof in the undeformed configuration.

2. The adaptive assisted grip apparatus of claim 1, wherein the elongated piece of material is cylindrical shaped.

3. The adaptive assisted grip apparatus of claim 1, wherein an outer surface of the elongated piece of material comprises a textured material configured to facilitate the outer surface being grasped and held by the user.

4. The adaptive assisted grip apparatus of claim 1, wherein the insertion opening extends fully through the holder and is configured to receive the cosmetics product inserted through the insertion opening.

5. The adaptive assisted grip apparatus of claim 1, wherein the wrist strap connection opening extends fully through the holder perpendicular to the length of the holder and the wrist strap is connected to the holder by the wrist strap received and extending through the connection opening.

6. The adaptive assisted grip apparatus of claim 1, wherein the cosmetics product comprises a facial makeup applicator.

7. The adaptive assisted grip apparatus of claim 1, wherein the cosmetics product is a lipstick tube, a makeup pencil, or a makeup brush.

8. The adaptive assisted grip apparatus of claim 1, wherein the wrist strap comprises a continuous loop of material configured to stretch and be moved over the user's hand and positioned around the user's wrist and worn by the user.

9. The adaptive assisted grip apparatus of claim 1, wherein the wrist strap comprises a separable loop of material and further comprises a clasp, and wherein the wrist strap is configured such that the wrist strap is separable by the clasp and configured to thereby be positioned around the user's wrist and worn by the user.

10. The adaptive assisted grip apparatus of claim 1, wherein the wrist strap comprises a separable loop of material and further comprises a hook and loop closure, and wherein the wrist strap is configured such that the wrist strap is separable by the closure and configured to thereby be positioned around the user's wrist and worn by the user.

11. The adaptive assisted grip apparatus of claim 1, wherein the wrist strap comprises a separable loop of material and further comprises a button closure, and wherein the wrist strap is configured such that the wrist strap is separable by the closure and configured to thereby be positioned around the user's wrist and worn by the user.

12. The adaptive assisted grip apparatus of claim 1, further comprising a ring, wherein the wrist strap connection opening extends fully through the holder perpendicular to the length of the holder, the ring is connected to the holder by the ring received and extending through the connection opening, and the wrist strap is coupled to the holder by the wrist strap received and extending through the ring.

13. The adaptive assisted grip apparatus of claim 1, further comprising a pin, wherein the pin is connected to the holder by the pin connected to the connection opening and the wrist strap is coupled to the holder by the wrist strap connected to the pin.

14. The adaptive assisted grip apparatus of claim 1, further comprising a pin and a snap hook, wherein the wrist strap connection opening extends parallel to the length of the holder opposite the insertion opening, the pin is connected to the holder by the pin connected to the connection opening, the snap hook is connected to the pin, and the wrist strap is coupled to the holder by the wrist strap received and extending through the snap hook.

15. A method of using the adaptive assisted grip apparatus of claim 1, comprising:

inserting the cosmetics product into the insertion opening of the holder;

positioning the wrist strap around the user's wrist such that the wrist strap is worn by the user;

holding and using the inserted cosmetics product by the user handling the holder;

preventing the holder from falling to the ground or floor surface by the wrist strap worn by the user when the user drops the holder.

16. The adaptive assisted grip apparatus of claim 1, wherein the wrist strap is fixedly secured to the holder.

17. The adaptive assisted grip apparatus of claim 1, wherein the wrist strap is a decorative wrist strap.

18. The adaptive assisted grip apparatus of claim 17, wherein the decorative wrist strap comprises at least one selected from the group of beads and pearls.

19. An adaptive assisted grip apparatus, comprising a holder and a wrist strap, wherein:

the holder comprises an elongated piece of resilient, compressible material having an insertion opening and a wrist strap connection opening;

the insertion opening extends at least partially into the holder parallel to the length of the holder;

the insertion opening is configured to receive a cosmetics product inserted at least partially into the opening, the insertion opening further configured to expand and contract to accommodate both the size and the shape of the inserted cosmetics product, and to thereby grip and retain the cosmetics product within the insertion opening, wherein the cosmetics product comprises a facial makeup applicator;

the wrist strap connection opening extends at least partially into the holder;

the wrist strap connection opening is configured to couple the wrist strap to the holder such that the wrist strap prevents the holder from falling to a ground or floor surface when the wrist strap is worn by the user and the user drops the holder from the user's hand;

the holder is configured to be held in the hand of a user and to hold the cosmetics product at least partially inserted into the insertion opening such that the cosmetics product can be held and used by the user by handling the holder;

the wrist strap comprises a loop of material coupled to the holder by the wrist strap opening and configured to be positioned around the user's wrist and worn by the user; and the wrist strap is configured to couple to the holder and prevent the holder from falling to the ground or floor surface when the wrist strap is worn by the user and the user drops the holder from the user's hand;

whereby the adaptive assisted grip apparatus is configured to allow the user to grab and hold the cosmetics product and to prevent the cosmetics product from falling to the ground or floor surface when the user drops the cosmetics product; and wherein:

the insertion opening is configurable in an undeformed configuration when the cosmetics product is not received in the insertion opening and a deformed configuration when the cosmetics product is received within the insertion opening;

the insertion opening defines a length; and a width of the insertion opening is consistent along the length thereof in the undeformed configuration.

20. A method of using the adaptive assisted grip apparatus of claim 19, comprising:

inserting the cosmetics product into the insertion opening of the holder;

positioning the wrist strap around the user's wrist such that the wrist strap is worn by the user;

holding and using the inserted cosmetics product by the user handling the holder; and preventing the holder from falling to the ground or floor surface by the wrist strap worn by the user when the user drops the holder.

21. An adaptive assisted grip apparatus for a cosmetics product, comprising a holder and a wrist strap, wherein:

the holder comprises an elongated piece of resilient, compressible material having an insertion opening and a wrist strap connection opening;

the insertion opening extends at least partially into the holder parallel to the length of the holder;

the insertion opening is configured to receive the cosmetics product inserted at least partially within the insertion opening, the insertion opening further configured to expand and contract to accommodate both the size and the shape of the inserted cosmetics product, and to thereby grip and retain the cosmetics product within the insertion opening;

the wrist strap connection opening extends at least partially into the holder;

the wrist strap connection opening is configured to couple the wrist strap to the holder such that the wrist strap prevents the holder from falling to a ground or floor surface when the wrist strap is worn by the user and the user drops the holder from the user's hand;

the holder is configured to be held in the hand of a user and to hold the cosmetics product at least partially inserted into the insertion opening such that the cosmetics product can be held and used by the user by handling the holder;

the wrist strap comprises a loop of material coupled to the holder by the wrist strap opening and configured to be positioned around the user's wrist and worn by the user; and the wrist strap is configured to couple to the holder and prevent the holder from falling to the ground or floor surface when the wrist strap is worn by the user and the user drops the holder from the user's hand;

whereby the adaptive assisted grip apparatus is configured to allow the user to grab and hold the cosmetics product and to prevent the cosmetics product from falling to the ground or floor surface when the user drops the cosmetics product; and wherein the insertion opening is open at a first end of the holder and closed at a second end of the holder, and wherein the wrist strap is affixed to the holder at the second end.

* * * * *